United States Patent [19]

Sakai et al.

[11] 3,945,824

[45] Mar. 23, 1976

[54] PROCESS FOR FORMING OPTICAL SOUND TRACK

[75] Inventors: Tadao Sakai; Masayoshi Kawai; Nobuo Yamamoto; Masakazu Yoneyama, all of Minami-ashigara, Japan

[73] Assignee: Fuji Photo Film Co., Ltd., Minami-ashigara, Japan

[22] Filed: Aug. 5, 1974

[21] Appl. No.: 494,931

[30] Foreign Application Priority Data

Aug. 3, 1973 Japan ..... 48-87727

[52] U.S. Cl. ..... 96/4; 96/22; 96/55; 96/60 BF; 96/66 R

[51] Int. Cl.[2] .. G03C 7/24; G03C 7/16; G03C 5/32; G03C 5/30

[58] Field of Search ..... 96/4, 22, 55, 60, 66 R, 96/60 BF

[56] References Cited

UNITED STATES PATENTS

| | | | |
|---|---|---|---|
| 2,648,604 | 7/1953 | Welliver et al. | 96/55 |
| 3,705,800 | 12/1972 | Lane | 96/4 |
| 3,705,803 | 12/1972 | Bevis et al. | 96/4 |

*Primary Examiner*—David Klein
*Assistant Examiner*—Alfonso T. Suro Pico
*Attorney, Agent, or Firm*—Sughrue, Rothwell, Mion & Zinn

[57] ABSTRACT

A process for forming an optical sound track which comprises applying a nitrogen containing heterocyclic compound in which at least one of the nitrogen atoms is connected to a group having 6 or more carbon atoms to form a quaternary salt to a sound track area of a multilayer color photographic material, after color development but prior to a bleaching step, whereby an optical sound track can be easily prepared on a conventional multilayer color photographic material.

22 Claims, No Drawings

PROCESS FOR FORMING OPTICAL SOUND TRACK

BACKGROUND OF THE INVENTION

1. Field of the Invention

The present invention relates to a process for forming sound images on a color photographic material and, more particularly, to a process for forming an optical sound track on a multilayer color photographic material.

2. Description of the Prior Art

In general, there are two types of processes for recording sound images on a color photographic material for use in the field of motion pictures or television: one is an optical sound-recording system and the other is a magnet sound-recording system. The present invention relates to a process for forming sound tracks suitable for use in the optical sound-recording system.

The reproduction of sound by an optical sound-recording system in a color print film, a color reversal film, a color reversal print film, etc. as is used in the field of motion pictures or television is accomplished by the steps of converting a sound signal recorded on a film as a variation in density or area to a light signal, converting the light signal to an electrical signal by means of a light acceptor and then converting the electrical signal to a sound signal. In such reproduction steps, photoelectric tubes having various spectral characteristics are used as a light acceptor. Of these, the one used most universally is designated S-1 type, which has a spectral sensitivity maximum in the infrared region at about 800 m$\mu$ (see, for example, Adrin Cornwell Clyne, *Color Cinematography*, page 593 (1951)).

On the other hand, in conventional color photographic materials based on a subtractive color process, the main absorption of the dyes formed by the coupling reaction between an oxidation product of a color developing agent, such as a p-phenylenediamine, and a color coupler is always in a region of the visible spectrum, which absorption therefore does not coincide with the spectral characteristics of the abovedescribed photoelectric tube. These color dye images provide, therefore, a sound output which is too weak to be practical. Consequently, in recording sound on a color photographic material, usually a processing step which forms silver images or silver sulfide on a sound track is carried out, and the density in the infrared region of the thus obtained silver images or silver sulfide images is utilized for the reproduction of sound. The infrared density (transmitting density) of these silver or silver sulfide images ranges generally from 1.0 to 0.6.

The production of sound tracks on a color print film can be carried out by using the procedures as described in, for example, *Journal of the Society of Motion Picture and Television Engineers*, vol. 77, page 1154 (1968).

According to these procedures, color images in picture areas and sound images in sound track areas are color-developed at the same time in a color developing bath. In a first fixing bath, unexposed silver halide is removed and, in a bleaching bath, developed silver produced by the developing step is rehalogenated. In the sound developing step, silver halide only in the sound track areas is converted to a silver image by selectively applying a viscous sound developer solution to the sound track areas. In a second fixing bath, the silver halide in the picture areas is fixed and removed and, in a stabilizing bath, the image dyes are stabilized. The density in the infrared region of the silver images thus formed on a sound track is predominantly utilized for the reproduction of sound.

Therefore, in the production of sound tracks in a color film, the step for forming the silver images or the silver sulfide images is indispensable as described above. The reason for forming a sound track comprising silver or silver sulfide is, as described above, because the photoelectric tube which is employed in the process of sound reproduction has its maximum sensitivity in the infrared region, while in such region of the spectrum the density of color dyes formed by color developing step is insufficiently low. Accordingly, the step to produce silver images or silver sulfide images in the sound track area is needed in addition to the step of forming dye images in the picture area.

Recently, methods to produce sound tracks without such a step have been provided. For example, as described in U.S. Pat. applications Ser. Nos. 439,675, filed Feb. 4, 1974, 451,658, filed Mar. 15, 1974 and U.S. Pat. Nos. 3,705,801, 3,715,208, and 3,737,312, a color photographic light-sensitive material which comprises an auxiliary layer containing a compound which is capable of protecting the sound image from the effect of a bleaching agent and restraining silver bleaching (a silver bleach inhibitor) is provided. When using a light-sensitive material as described, it is possible to form sound images simply by conventional color processing without conducting the so-called sound development. However, these light-sensitive materials having such an auxiliary layer containing a silver bleach inhibitor entail certain disadvantages. That is, due to the formation of the auxiliary layer (the sound track forming layer) in addition to the conventional image forming layers, the sensitivity of the image forming layers which are positioned under the sound track forming layer is reduced and the sharpness of the images decreases markedly. For example, when the sound track forming layer is formed in the farthest position from the support (uppermost position), the frequency modulation property of the sound images is improved but the sharpness of picture images decreases. On the contrary, when the sound track forming layer is located closest to the support, the sharpness of the picture images formed in the image forming layers over the sound track forming layer is not affected but good frequency modulation properties cannot be obtained. This is a great difficulty in the practical use of these color photographic light-sensitive materials having such an auxiliary sound track forming layer.

Another method of forming sound tracks without a sound developing step is described in Japanese Pat. application Laid Open No. 24431/74 and U.S. Pat. No. 3,705,800, in which a multilayer color photographic light-sensitive material is developed to form a picture record comprising silver and a dye and a sound track record comprising silver and then a silver bleach inhibitor is selectively applied to the silver of the sound track record. in Japanese Pat. application Laid Open No. 24431/74, the disclosure is that a compound having at least two oxyalkylene groups or a compound having at least one mercapto group can be suitably used as the silver bleach inhibitor. According to the method described in Japanese Pat. application Laid Open No. 24431/74, after development of a multilayer color photographic light-sensitive material, the silver bleach inhibitor as mentioned above is applied to only the sound track area containing silver to protect the silver sound track record from the action of the silver bleaching agent, and then the material is treated in a single bleach-fixing bath. Although a shortening of the overall processing time can be achieved by treating in such a bleach-fixing bath, this method is accompanied by the following disadvantage. That is, in order to recover silver from a treating bath for a color photographic light-sensitive material, in particular a motion picture film, a method of electrolyzing the fixing solution is generally and preferably used. The method is described, for example, in *Journal of the Society of Motion Picture and Television Engineers*, vol. 81, pages 603–608. However, when such a single bleach-fixing bath as described in Japanese Patent Application Laid Open No. 24431/74, German Pat. Nos. 866,605 and 966,410, and *British Journal of Photography*, pages 122–123 and 126 (1966) is employed, the silver recovery by electrolysis is difficult to perform due to the presence of other metal ions than a silver ion such as an iron ion in the solution.

Also Japanese Pat. application Laid Open No. 13483/72 describes a method for preparing a sound track which comprises developing a multi-layer color photographic light-sensitive material, contacting the sound track area containing silver with a silver bleach inhibitor having a mercapto group or a seleno group, and carrying out the bleaching step. According to the method, the silver bleach inhibiting action may be enhanced by using an onium salt such as a quaternary ammonium compound, a quaternary phosphonium compound or a tertiary sulfonium compound together with the silver bleach inhibitor having a mercapto group or a seleno group, however, the description is that these onium salts are not silver bleach inhibitors within the meaning of the term as defined therein.

SUMMARY OF THE INVENTION

Accordingly, it is an object of the present invention to provide a new method of forming an optical sound track.

Another object of the present invention is to provide a method of forming a sound record suitable for a color photographic light-sensitive material which is not subjected to a reversal processing step, such as, for example, a color print film (color positive film).

Still another object of the present invention is to provide a method of forming a sound record which can be easily composed into a series of processing steps of a color photographic light-sensitive material.

A further object of the present invention is to provide a method of forming an excellent color image and sound record in a simple and rapid manner using a conventional color photographic light-sensitive material.

These objects can be attained by applying a nitrogen containing heterocyclic compound in which at least one of the nitrogen atoms is connected to a group having 6 or more carbon atoms to form a quaternary salt ot a sound track area of a color-developed multi-layer color photographic light-sensitive material and then bleaching the color-developed material.

DETAILED DESCRIPTION OF THE INVENTION

The process of forming an optical sound track according to the present invention comprises contacting the sound track area of a color photographic material with a nitrogen containing heterocyclic compound in which at least one of the nitrogen atoms is connected to a group having 6 or more carbons atoms to form a quaternary salt to selectively restrain the bleaching of silver in the sound track area, as a silver bleach inhibitor, after the color-developing but prior to the bleaching of the color photographic material.

The fact that the heterocyclic quaternary salt compound alone can be used effectively as a silver bleach inhibitor according to the present invention is very surprising when the description in the above-described Japanese Pat. application Laid Open No. 13483/72 that the onium salts are not silver bleach inhibitors is considered. Further, when the silver bleach inhibitor having a mercapto group or a seleno group and the onium salt are used in combination, it is occasionally found that the bleach inhibitor does not dissolve. However, such a disadvantage does not occur in the present invention in which the quaternary salt of the present invention is employed.

In a preferred embodiment of the present invention, the multi-layer color photographic light-sensitive material comprises a support having coated thereon a first silver halide emulsion layer sensitive to a first region of the visible spectrum and containing a coupler capable of forming a yellow dye by reacting with an oxidation product of a color developing agent, a second silver halide emulsion layer sensitive to a second region of the visible spectrum and containing a coupler capable of forming a magenta dye by reacting with an oxidation product of a color developing agent, and a third silver halide emulsion layer sensitive to a third region of the visible spectrum and containing a coupler capable of forming a cyan dye by reacting with an oxidation product of a color developing agent. The light-sensitive material can further include a backing layer containing carbon black, etc., a subbing layer, an antihalation layer containing black colloidal silver, etc., a yellow filter layer containing yellow colloidal silver, etc., a gelatin inter layer, a protective layer, and the like.

An image exposure from a picture original and a sound image exposure from a sound original are provided to a multilayer color photographic light-sensitive material, for example such as those described above, and the photographic material is subjected to color development to form images comprising a silver image and dye image in the picture record area and the sound record area. A solution containing a silver bleach inhibitor is then applied to only the sound track area of the photographic material. Upon bleaching the photographic material the silver image in the picture area is bleached, whereas the silver image in the sound track area remains which is treated with the silver bleach inhibitor to render the silver unbleachable. Subsequently the photographic material is treated with a fixing solution to remove the unexposed silver halide and the bleached silver while the silver image in the sound track area remains. Thus the dye image in the picture area and the silver image in the sound track area are formed. The silver image in the sound track area can be utilized as a sound image.

In another preferred embodiment of the present invention, a photographic material can be treated with a pre-bath in order to remove a backing layer prior to color development, or can be treated with a pre-hardening bath for hardening the photographic layers prior to color development.

In a further preferred embodioment of the present invention, a photographic material can be treated, after color development but prior to applying a silver bleach inhibitor to the sound track area, with a stop bath, a stop-fixing bath or a fixing bath.

In a still further preferred embodiment of the present invention, a photographic material can be treated with a stabilizing bath to stabilize the color images after the fixing treatment. Further between each treatment step a washing step can be interposed.

The term "sound track area" or "sound record area" as used in this specification refer to the area of a motion picture film as the area seen in a plane view, and the position and the width are defined as described in ASTM PH 22.40-1967 for 35 mm film and ASTM PH 22.41-1969 for 16 mm film.

The silver bleach inhibitor employed in the present invention is a nitrogen containing heterocyclic compound in which at least one of the nitrogen atoms is connected to a group having 6 or more carbon atoms up to about 100 carbon atoms to form a quaternary salt. The number of carbon atoms which is contained in the group connected to the nitrogen atom greatly influences the silver bleach inhibiting action of the compound. A nitrogen containing heterocyclic compound in which a group having 4 carbon atoms connected to the nitrogen atom to form a quaternary salt does not exhibit any silver bleach inhibiting action. Compounds having a group of 8 or more carbon atoms connected to the nitrogen atom show a particularly preferred silver bleaching action. Compounds in which the nitrogen containing heterocyclic ring is selected from a pyridine ring, an imidazole ring or a quinoline ring are particularly advantageous.

The nitrogen containing heterocyclic ring can have substituents on the ring forming atoms other than the quaternary nitrogen atom. Of these substituents an alkyl group having 1 to 12 carbon atoms, for example, a methyl group, an ethyl group, a propyl group, a butyl group, a hexyl group, an octyl group, a dodecyl group, etc., is preferred. The groups connected to the nitrogen atom having 6 or more carbon atoms include a substituted or unsubstituted alkyl or alkenyl group. Suitable alkyl group substituents include a hydroxy group, an alkoxy group, an aryloxy group, an acyloxy group, an acylamino group, an amino group, a carbamoyl group, an alkylthio group, an aryl group and the like. In the compound which can be used in the present invention, the anion which forms the quaternary salt is not limited and those derived from a bromide, a chloride, a thiocyanate, a sulfonate, a perchlorate, etc., can be preferably used.

Compounds which can be advantageously used as silver bleach inhibitors in the present invention are a pyridinum salt, an imidazolium salt and a quinolium salt. The compounds represented by the following general formula (I) are particularly preferred.

General Formula (I)

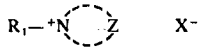

wherein Z represents the atoms necessary to form a substituted or unsubstituted pyridine ring, imidazole ring or quinoline ring; $X^-$ represents an anion; and $R_1$ represents a group having 6 or more carbon atoms and selected from the following groups (a) to (d):

a. a substituted or unsubstituted alkyl or alkenyl group, (b) $R_2—A—CH_2\underset{\underset{OH}{|}}{C}HCH_2—$, (c) $R_2—B—\underset{\underset{R_3}{|}}{C}H—$, (d) $R_2—A—(C)_m—(D)_n—(CH_2\underset{\underset{OH}{|}}{C}HCH_2)_p—$ wherein $R_2$ represents a substituted or unsubstituted alkyl or alkenyl group or alkaryl group; $R_3$ represents a hydrogen atom or a methyl group; A represents —O—, —S—, —COO— or $—NCH_3—$; B represents —O—, —COO—, —CONH— or $—CONHC_2H_4CONH-$; C represents an oxyalkylene group; D represents $—CH_2CH_2—$ or —O—; m represents an integer of 1 to 40; n represents 0 or 1; and p represents 0 or 1. The alkyl or alkenyl moiety in (a) above preferably has 6 to 30 carbon atoms and preferred substituents are a hydroxy group, a halogen atom, and an aryl group, etc. Examples of unsubstituted alkyl groups include, for example, a hexyl group, an octyl group, a decyl group, a dodecyl group, a tetradecyl group, an octadecyl group, a nonadecyl group, and the like. Examples of substituted alkyl groups include, for example, a 1,1-2H-perfluorooctyl group, a p-nonylbenzyl group, a p-octylbenzyl group, a p-tert-butylbenzyl group, and the like. Suitably $R_2$ in (b), (c) and (d) above can have from 3 to 20 carbon atoms in the alkyl moiety thereof and examples of substituents include a hydroxy group, a halogen atom, an aryl group, etc. Examples of unsubstituted alkyl groups include an octyl group, a dodecyl group, a 2-methyldodecyl group, a 2-ethylhexyl group, etc., and examples of substituted alkyl groups include a 1,1-2H-perfluorooctyl group, a p-nonylbenzyl group, a p-tert-butyl-benzyl group, etc. Suitable examples of oxyalklylene groups include an oxyethylene group and an oxypropylene group. Specific examples of silver bleach inhibitors which can be used in the present invention are illustrated below.

| | Compound |
|---|---|
| 1 | 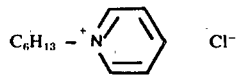 |
| 2 | 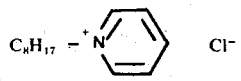 |

-continued
| | Compound |
|---|---|
| 3 | $C_{10}H_{21}$ 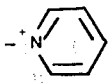 $Cl^-$ |
| 4 | $C_{12}H_{25}$ 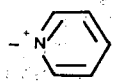 $Cl^-$ |
| 5 | $C_{18}H_{37}$ 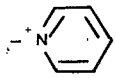 $Cl^-$ |
| 6 | $C_{11}H_{23}$ 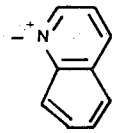 $Cl^-$ |
| 7 | $C_{14}H_{29}$ 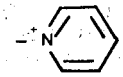 $Br^-$ |
| 8 | $C_{16}H_{33}$ 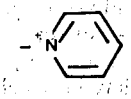 $Cl^-$ |
| 9 | $C_{14}H_{29}-O-CH_2CH(OH)CH_2$ 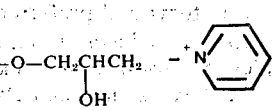 $Cl^-$ |
| 10 | $C_{12}H_{25}-S-CH_2CH(OH)CH_2$ 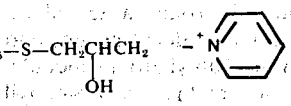 $Cl^-$ |
| 11 | $C_{18}H_{37}COOCH_2CH(OH)CH_2$ 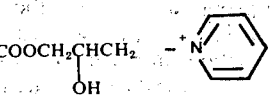 $Cl^-$ |
| 12 | $C_{12}H_{25}-O-CH_2CH(OH)CH_2$ 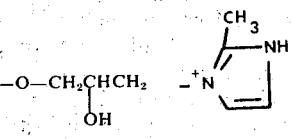 $Cl^-$ |
| 13 | $C_{14}H_{29}-O-CH_2CH(OH)CH_2$ 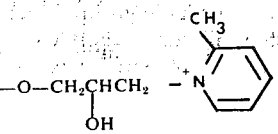 $Cl^-$ |
| 14 | $C_{12}H_{25}-N(CH_3)-CH_2CH(OH)CH_2$ 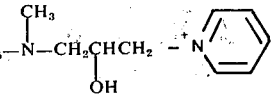 $Cl^-$ |
| 15 | $C_9H_{19}$  $-OCH_2CH(OH)CH_2$ 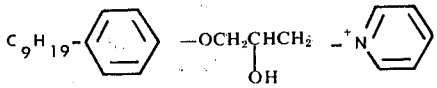 $Br^-$ |

-continued
| | Compound |
|---|---|
| 16 | 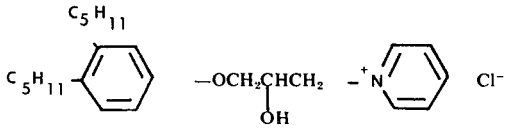 |
| 17 | 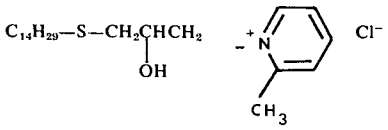 |
| 18 | 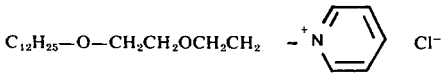 |
| 19 | 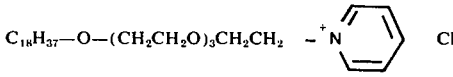 |
| 20 | 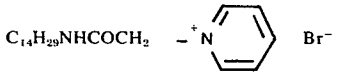 |
| 21 | 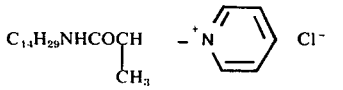 |
| 22 | 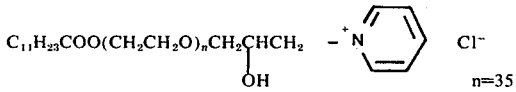 n=35 |
| 23 | 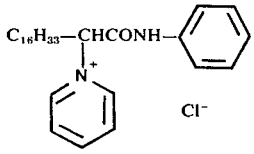 |
| 24 | 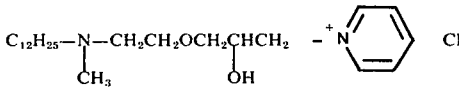 |
| 25 | 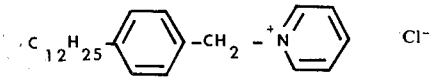 |
| 26 | 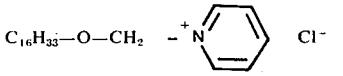 |
| 27 | 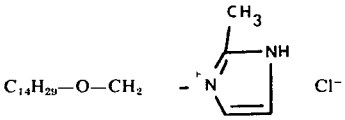 |
| 28 | 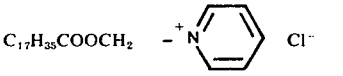 |

-continued
| | Compound |
|---|---|
| 29 | $C_{16}H_{33}CONHCH_2$ 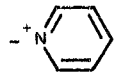 $Cl^-$ |
| 30 | 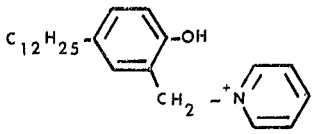 $Cl^-$ |
| 31 | 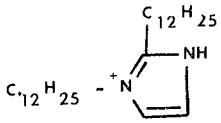 $Cl^-$ |
| 32 | $C_{11}H_{23}CONHCH_2CH_2CONHCH_2$ 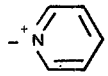 $Cl^-$ |
| 33 | $C_{11}H_{23}CON(CH_3)CH_2$ 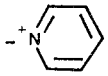 $Cl^-$ |
| 34 | $C_{11}H_{23}CON(CH_2)CH_2$ 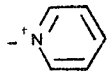 $Cl^-$<br>$C_{11}H_{23}CON(CH_2)CH_2$ 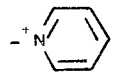 $Cl^-$ |
| 35 | 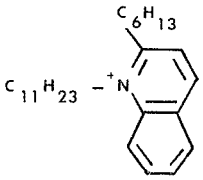 $Cl^-$ |
| 36 | $CH_3(CH_2)_7CH{=}CH(CH_2)_8$ 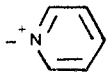 $Cl^-$ |
| 37 | $CH_3(CH_2)_7CH{=}CH(CH_2)_7COOCH_2CH(OH)CH_2$ 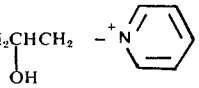 $Cl^-$ |
| 38 | $CH_3(CH_2)_7CH{=}CH(CH_2)_7COOCH_2$ 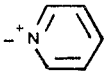 $Cl^-$ |
| 39 | $C_{14}H_{29}COOCH_2CH(CH_3)OCH_2CH(OH)CH_2$ 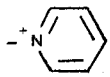 $Cl^-$ |

-continued

| Compound |
|---|
| $C_7F_{15}CONHCH_2CH_2$ 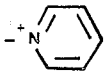 $Cl^-$ |

The silver bleach inhibitors used in the present invention can be easily prepared using conventional methods. For example, the methods described in *Kogyo Kagaku Zasshi* (*Journal of Industrial Chemistry*), vol. 63, pages 595–600 (1960) or in U.S. Pat. No. 3,545,974 can be utilized. A specific example of the synthesis is illustrated below as to Compound 9.

1284 g of tetradecyl alcohol was dissolved by heating and 2.0 g of stannic tetrachloride was added as a catalyst. With vigorous stirring 148 g of epichlorohydrin was added at once. After a reaction time of 3 hours at 120°–130°C with stirring, the reaction mixture was cooled to 45°–50°C and a small amount of an aqueous solution of potassium carbonate was added and the mixture was vigorously stirred to decompose the catalyst. The mixture was dried by addition of anhydrous sodium sulfate, then filtered and distilled under reduced pressure to separate unreacted tetradecyl alcohol from the crude product. The crude product was again distilled to give 350 g of tetra-decyl-3-chloro-2-hydroxypropyl ether with a boiling point of 176°–180°C/3 mmHg (yield 73.3 percent). 307 g of tetradecyl-3-chloro-2-hydroxypropyl ether and 237 g of pyridine were added to a flask and refluxed for 10 hours at 130°–140°C. After cooling, excess pyridine was removed by distillation under reduced pressure. The residue was recrystallized from a solvent mixture of acetone and ethanol. 272 g of 2-hydroxy-3-tetradecyloxypropyl pyridinium chloride with a melting point of 91°C was obtained (yield 71.5%). Other compounds can be prepared in a similar manner according to the method above.

The silver bleach inhibitor in the present invention can be used alone or as a combination of two or more thereof. When a combination of two or more is used, it is observed that the silver bleach inhibiting function is occasionaly increased to an even greater extent. Also the silver bleach inhibitor of the present invention can be used together with other compounds which have a silver bleach inhibiting function or which promote the silver bleach inhibiting function. Suitable examples of these compounds are described in U.S. Pat. application Ser. No. 360,507, filed May 15, 1973, now U.S. Pat. No. 3,869,287 and aforementioned U.S. Pat. application Ser. No. 451,658, filed Mar. 15. 1974.

In accordance with the present invention, it is only necessary to being a solution containing the silver bleach inhibitor into contact with a sound track area of a photographic material after color development but prior to a bleaching step. The contacting procedure is not dependent upon critical concentrations, times or temperature. The silver bleach inhibitor is generally applied as an aqueous solution. The solution, however, can contain an organic solvent which is miscible with water, for example, such as methanol, ethanol, etc.

The solution containing a silver bleach inhibitor which can be used in the present invention can contain a conventional thickening agent such as a tragacanth gum, a xanthane gum, a copolymer of methyl vinyl ether and maleic anhydride (available from GAF Corporation under the trade name of Gantrez-AN-4651) to increase the viscosity.

The concentration of the silver bleach inhibitor in the silver bleach inhibitor treatment solution used in the present invention can range generally from about 0.5 to about 30 weight%. and preferably from 1 to 20 weight%. The treatment solution containing the silver bleach inhibitor can be applied to a color photographic material over any range of acidic, neutral and alkaline. A preferred range is from a pH of about 5 to a pH of about 13.

The temperature at which the silver bleach inhibitor solution can be brought into contact with the sound track area can vary widely. However, use of approximately the same temperature as the temperature employed for the remainder of the processing solutions is preferred. Photographic processing temperatures conventionally range from about 20°C or less to about 60°C or higher, preferably about 30°C to 55°C, and the procedure of the present invention can be preferably carried out in this range.

The time the silver bleach inhibitor solution can be in contact with a sound track area can also vary widely. Usually the time ranges from about 5 seconds or less to about 10 minutes or more and preferably, it ranges from about 20 seconds to about 5 minutes.

The silver bleach inhibitor solution can be applied to a color photographic material using any convenient method. A sound applicator which has been used for coating a sound developer on a sound track area of a color photographic material is particularly useful.

As the support for the photographic material used in the present invention to which light-sensitive silver halide emulsion layers are applied, a cellulose ester film such as cellulose nitrate, cellulose acetate, etc., a polyester film such as polyethylene terephthalate, etc., a polyvinyl chloride film, a polystyrene film, a polycarbonate film and the like are illustrated and are preferred.

Any known hydrophilic colloids used in silver halide emulsion layers can be used. Gelatin, a gelatin derivative (for example an acylated gelatin such as described in U.S. Pat. No. 3,118,766, a graft gelatin having as a graft portion a vinyl monomer such as acrylic acid, etc., as described in U.S. Pat. No. 2,831,767), albumin, gum arabic, agar-agar, a cellulose derivative (an alkyl ester of carboxymethyl cellulose, hydroxyethyl cellulose, carboxymethyl hydroxyethyl cellulose, etc.), a synthetic resin (polyvinyl alcohol, polyvinyl pyrrolidone, etc.) and the like are preferred. These hydrophilic colloids can also be used as the binder for layers which constitute the light-sensitive material (for example, a protective layer, a filter layer, an inter layer, an antihalation layer, a subbing layer, a backing layer, etc.) other than the emulsion layers.

The hydrophilic colloid used in the various layers of the light-sensitive material is advantageously hardened with a hardener of an aldehyde type, a methylol type, a 1,4-dioxane type, an aziridine type, an ioxazole type, a carbodiimide type, an active halogen type, an active vinyl type and the like.

Typical examples of these hardeners are described in U.S. Pat. Nos. 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 3,091,537; 3,543,292 and British Pat. Nos. 974,723; 1,167,207 and 994,869, etc.

In the light-sensitive material in the present invention, all silver halide emulsions which are used in the photographic field, for example, silver bromide, silver iodobromide, silver chloroiodobromide, silver chlorobromide, silver chloride, etc. emulsions can be used. Further the so-called converted-halide silver halide grains such as described in British Pat. No. 635,841 and U.S. Pat. No. 3,622,318, etc. are also useful.

The silver halide photographic emulsion of the light-sensitive material used in the present invention can be chemically sensitized using the natural sensitizers in gelatin. The emulsion can also be chemically sensitized with a sulfur compound as described in U.S. Pat. Nos. 1,547,944; 1,623,499 and 2,410,689. The emulsion can be chemically sensitized with a palladium or a gold salt as described in U.S. Pat. Nos. 2,399,083 and 2,642,361. The emulsion can also be sensitized with a reducing agent such as a stannous salt as described in U.S. Pat. No. 2,487,850, or a reducing agent such as a polyamine as described in U.S. Pat. No. 2,521,925. The emulsion can further be spectrally sensitized with a cyanine dye or a merocyanine dye as described in U.S. Pat. Nos. 2,519,001; 2,666,761; 2,734,900; 2,739,964 and 3,481,742. The emulsion can contain a stabilizer such as a mercury compound, an azaindene, etc., a plasticizer such as glycerin, etc., a coating aid such as saponin, polyethylene glycol monolauryl ether, etc. The emulsion can further contain an antistatic agent, a ultraviolet absorber, a fluorescent brightening agent, a dye and the like.

In the present invention, all open-chain ketomethylene type yellow dye forming color couplers can advantageously be used. Typical examples thereof include a benzoylacetanilide type color coupler, a pivaloyl acetanilide type color coupler, etc. All magenta dye forming color couplers such as a pyrazolone type, a indazolone type, etc., can advantageously be used. Also, all cyan dye forming couplers such as a phenol type and a naphthol type, etc. can be advantageously used. These color couplers can have a coupling releasing group at the active carbon atom of the coupling position. Color couplers which are rended non-diffusible by introducing a ballasting group in the molecule are preferred. The terms "coupling releasing group," "ballasting group" and "non-diffusible" are conventionally used in connection with color couplers, and their meanings are well known to those skilled in the art. Various kinds of these color couplers are well known. Particularly preferred color couplers are selected from a yellow dye forming color coupler capable of reacting with an oxidation product of a color developing agent to form a dye having an absorption maximum in the wavelength region of about 420 to 460 m$\mu$, a magenta dye forming color coupler to form a dye having an absorption maximum in the wavelength region of about 520 to 570 m$\mu$ and a cyan dye forming color coupler to form a dye having an absorption maximum in the wavelength region of about 630 to 710 m$\mu$.

Specific examples of non-diffusible color couplers are described in, for example, U.S. Pat. Nos. 1,108,028; 2,186,849; 2,206,142; 2,343,702; 2,367,531; 2,369,489; 2,423,730; 2,436,130; 2,474,293; 2,600,788; 2,689,793; 2,728,658; 2,742,832; 2,808,329; 2,998,314; 3,046,129; 3,062,653; 3,265,506; 3,311,476; 3,408,194; 3,419,390; 3,419,391; 3,458,315; 3,476,563; 3,516,831; 3,617,291 and British Pat. No. 1,183,515, etc.

These color couplers can be incorporated into the hydrophillic colloid of the photographic material using any known technique. For example, the color couplers can be dissolved in a high boiling organic solvent (e.g., boiling above 170°C) such as dibutyl phthalate, tricresyl phosphate, etc. as described in U.S. Pat. No. 2,322,027 and if desired together with a low boiling organic solvent (e.g., boiling below 170°C) such as ethyl acetate, tetrahydrofuran, etc., and the solution is dispersed in the hydorphilic colloid. Also, where the color couplers contain an acid group such as a carboxylic acid group or a sulfonic acid group, they can be incorporated into the hydrophilic colloid as an aqueous alkaline solution.

In accordance with the present invention, a multilayer color photographic light-sensitive material is exposed to form a picture image and a sound image, subjected to color development to form a picture record and a sound record containing silver, brought into contact with the silver bleach inhibitor only at the sound record area, and bleached to remove the silver only from the picture record area while in the sound record area a greater part of the silver remains, and thus a color photographic material having a sound track comprising silver can be obtained.

With respect to the photographic processing steps, all processings conventionally used in a processing of color photographic materials can be utilized except for the procedure of applying the silver bleach inhibitor to the sound track area.

Useful color developer solutions are aqueous alkaline solutions containing a color developing agent. As the color developing agent, all known primary aromatic amino dye forming developing agents, for example a para-phenylenediamine (for example, N,N-diethyl-para-phenylenediamine, N-ethyl-N-hydroxyethyl-para-phenylenediamine, N-ethyl-N-hydroxyethyl-2-methyl-para-phenylenediamine, N-ethyl-N-$\beta$-methanesulfonamidoethyl3-methyl-4-aminoaniline, N,N-di-ethyl-2-methyl-para-phenylenediamine, and the sulfates, hydrochlorides or sulfites thereof, etc.) can be used and are preferred. These are well known in the art, for example, as described in C. E. K. Mees and T. H. James *The Theory of the Photographic Process*, page 294–295, The Macmillan Co., 1966; U.S. Pat. Nos. 2,592,364 and 2,193,015, etc. The color developer solution can further contain additives conventionally used for example, a sulfite, a carbonate, a bisulfite, a bromide, or an iodide of an alkali metal, benzyl alcohol and the like.

All bleaching solutions containing known bleaching agents such as a ferricyanide, a bichromate, an iron (III) salt, etc. can be used. Any silver oxidizing agent used in a conventional bleaching solution can be used in the bleaching bath in the present invention. For example, a water-soluble ferricyanide (e.g., sodium ferricyanide, potassium ferricyanide, ammonium ferricyanide, etc.), a water-soluble quinone (e.g., quinone, chloroquinone, methylquinone, etc.), a water-soluble ferric salt (e.g.) ferric chloride, ferric sulfate, ferric thiocyanate, ferric oxalate, etc.), a water-soluble cupric salt (e.g., cupric chloride, cupric sulfate, etc.), a water-soluble cobaltic salt (e.g., cobaltic chloride, ammonium cobaltic nitrate, etc.) and the like can be used. Further, a complex salt between a polyvalent cation and an alkali metal and a water-soluble organic acid can also preferably be used. Suitable organic acids include compounds represented by the following formula.

$$HOOC - Q_1 - X - Q_2 - COOH$$

or

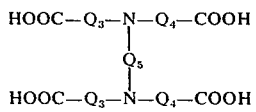

wherein X represents a hydrocarbon group, an oxygen atom, a sulfur atom or a $-NQ_6$ group, $Q_1$, $Q_2$, $Q_3$, $Q_4$ and $Q_5$ each represents a substituted or unsubstituted hydrocarbon group, and $Q_6$ represents a hydrogen atom or a substituted or unsubstituted hydrocarbon group.

Typical examples of suitable organic acids are malonic acid, tartaric acid, ethylmalonic acid, malic acid, fumaric acid, diglycoloic acid, thioglycolic acid, ethyliminodipropionic acid, nitrilotriacetic acid, ethylenediamine tetraacetic acid, aminotriacetic acid, ethylenedithioglycollic acid, dithioglycollic acid, dithioglycollic acid and the like.

Examples of polyvalent cations include a ferric ion, a cobaltic ion and a cupric ion. An iron sodium complex salt of ethylenediaminetetraacetic acid is particularly useful as a bleaching agent.

Specific examples of bleaching solutions are described in, for example, *Journal of the Society of Motion Picture and Television Engineers*, vol. 61, pages 667–701 (1953); U.S. Pat. No. 3,189,452; German Pat. Nos. 866,605 and 966,410; U.S. Pat. No. 3,582,322; and *British Journal of Photography*, vol. 107, pages 122–123 and 126 (1966).

For removing the soluble silver salt from a photographic material a fixing solution is used. All fixing solutions containing a compound conventionally used as a solvent for silver halide can be used. For example a water-soluble thiosulfate (e.g., sodium thiosulfate, potassium thiosulfate, ammonium thiosulfate etc.), a water-soluble thiocyanate (e.g., sodium thiocyanate, potassium thiocyanate, ammonium thiocyanate, etc.), a water-soluble organic diol fixing agent containing an oxygen atom or a sulfur atom (e.g., 3-thia-1,5-pentanediol, 3,6-dithia1,8-octanediol, 9-oxa-3,6,12,15-tetrathia-1,17-heptadecanediol, etc.), a water soluble sulfur-containing organic dibasic acid and a water-soluble salt thereof (e.g., ethylene bisthioglycollic acid, sodium salt thereof, etc.), a imidazolidinethione (e.g., methylimidazolidinethione, etc.) and the like are preferably used.

Further, the fixing agents described in L. F. A. Mason, *Photographic Processing Chemistry*, pages 187–188, Focal press (1966) can also preferably be used.

The bleaching step and the fixing step can be carried out in a single bath, if desired. In such case, the above described bleaching agent and fixing agent can be used in a suitable combination. Specific examples of the bleach-fixing baths are described in, for example, German Pat. No. 866,605 and U.S. Pat. No. 3,582,322, etc.

Each processing bath can advantageously be used in a system in which the baths are circulated for regeneration. Such a process is described in, for example, *Journal of the Society of Motion Picture and Television Engineers*, vol. 81, pages 293–295 (1972), etc.

Silver can be advantageously recovered from the fixing solution. A method of silver recovery is described in, for example, *Journal of the Society of Motion Picture and Television Engineers*, vol. 81, pages 603–608, etc.

The invention will now be explained in greater detail by reference to the following examples. Unless otherwise indicated, all parts, percents, ratios and the like are by weight.

EXAMPLE 1

On a surface of cellulose triacetate film support which has an anti-halation layer containing carbon black on the other surface, a subbing layer was provided, on which a coating solution containing a silver iodobromide emulsion containing 1.2 mol % of iodide (containing 0.05 mol of silver) and a dispersion prepared by dispersing α-(2-methylbenzoyl)-3-[α-(2,4-di-tert-amylphenyoxy)-acetamido] acetanilide, as a yellow coupler, together with dibutyl phthalate and ethyl acetate was applied to form a blue-sensitive layer. On the blue-sensitive layer, a gelatin inter layer was applied. On the inter layer a coating solution containing a silver chlorobromide emulsion containing 30 mol% of the bromide (containing 0.06 mol of silver) which was spectrally sensitized so as to have a sensitivity maximum at about 685 mμ and a dispersion prepared by dispersing 1-hydroxy-4-chloro-2-(N-hexadecyl)-naphthamide, as a cyan coupler, together with dibutyl phthalate was applied to form a red-sensitive layer. The optical sensitizing dye used has the following structure:

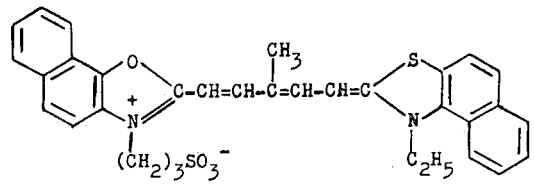

On the red-sensitive layer, a gelatin inter layer was applied. On the inter layer a coating solution containing a silver chlorobromide emulsion containing 35 mol% of the bromide (containing 0.06 mol of silver) which was spectrally sensitized so as to have a sensitivity maximum at about 555 mμ and a dispersion prepared by dispersing 1-(2,6-dichloro-4-methylphenyl)-3-{3-[α-(2,4-di-tert-amylphenoxy)butyramido]benzamido}-5-pyrazolone and 1-(2,4,6-trichlorophenyl)-3-[3-{α-(2,4-di-tert-amylphenoxy)-butyramido}benzamido]-5-pyrazolone, as a magenta coupler, together with tricresyl phosphate and ethyl acetate was applied to form a green-sensitive layer. The optical sensitizing dye had the following structure:

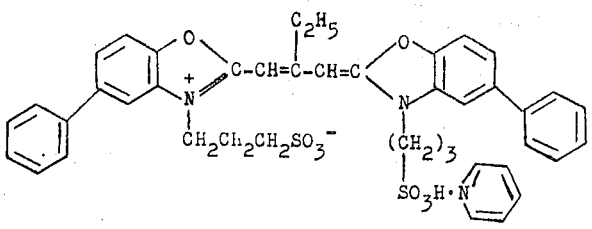

Subsequently, a coating solution containing liquid paraffin dispersed in an aqueous gelatin solution was coated to form a protective layer. Thus, a color print film which was designated Sample (I) was prepared.

In Sample (I), the coating amount of silver, coupler and gelatin (binder) and the thickness of a coating layer were as follows.

| Layer | Silver | Coupler | Gelatin | Thickness |
|---|---|---|---|---|
| Blue-sensitive Layer | 1.2 g/m² | 1.2 g/m² | 2.7 g/m² | 4.3 μ |
| Inter Layer | — | — | 0.8 g/m² | 0.6 μ |
| Red-sensitive Layer | 0.8 g/m² | 1.2 g/m² | 1.7 g/m² | 3.1 μ |
| Inter Layer | — | — | 0.8 g/m² | 0.6 μ |
| Green-sensitive Layer | 1.1 g/m² | 1.2 g/m² | 3.0 g/m² | 4.2 μ |
| Protective Layer | — | — | 0.8 g/m² | 0.6 μ |

The amount of sensitizing dye to silver was as follows:

| | |
|---|---|
| Red-sensitive Layer | 25 mg/mole of silver |
| Green-sensitive Layer | 250 mg/mole of silver |

Sample (I) was stepwise exposed to radiation from a light source of a tungsten lump through a silver wedge and subjected to processing according to Processing A, Processing B or Processing C. The infrared density of each film thus treated was measured with a Macbeth TD-206A type densitometer using a Status S-58 filter. The results obtained are shown in Table 1.

Processing A

| Processing Step | Temperature | Time |
|---|---|---|
| Pre-bath | 27°C | 10 sec. |
| Washing | " | 15 sec. |
| Color Development | " | 5 min. 20 sec. |
| Washing | " | 15 sec. |
| First Fixing | " | 1 min. |
| Washing | " | 40 sec. |
| Bleaching | " | 3 min. |
| Washing | " | 1 min. |
| Sound Development | Room Temperature | 15 sec. |
| Washing | 27°C | 15 sec. |
| Second Fixing | " | 2 min. |
| Washing | " | 5 min. |
| Stabilizing | " | 10 sec. |

The compositions of the processing solutions used were as follows.

| | |
|---|---|
| **Pre-bath Solution** | |
| Water | 800 ml |
| Sodium Carbonate (monohydrate) | 10.0 g |
| Sodium Sulfate (anhydrous) | 50.0 g |

-continued

| | |
|---|---|
| Water to make | 1.0 liter |
| **Color Developer Solution** | |
| Water | 800 ml |
| Sodium Hexametaphosphate | 2.0 g |
| Sodium Sulfite (anhydrous) | 4.0 g |
| 2-Amino-5-diethylaminotoluene Hydrochloride | 3.0 g |
| Sodium Carbonate (monohydrate) | 25.0 g |
| Potassium Bromide | 2.0 g |
| Water to make | 1.0 liter |
| **First Fixing Solution and Second Fixing Solution** | |
| Water | 600 ml |
| Sodium Thiosulfate (pentahydrate) | 240 g |
| Sodium Sulfite (anhydrous) | 15.0 g |
| Glacial Acetic Acid | 12.0 g |
| Boric Acid | 6.0 g |
| Potassium Alum | 15.0 g |
| Water to make | 1.0 liter |
| **Bleaching Solution** | |
| Water | 800 ml |
| Potassium Bromide | 20.0 g |
| Potassium Bichromate | 5.0 g |
| Potassium Alum | 40.0 g |
| Sodium Acetate (trihydrate) | 3.0 g |
| Glacial Acetic Acid | 10.0 g |
| Water to make | 1.0 liter |
| **Sound Developer Solution** | |
| Solution A | |
| Water | 600 ml |
| Sodium Sulfite (anhydrous) | 40.0 g |
| N-Methyl-p-aminophenol Sulfate | 40.0 g |
| Sodium Hydroxide | 40.0 g |
| Hydroquinone | 40.0 g |
| Solution B | |
| Water | 300 ml |
| Tragacanth Gum | 5.0 g |
| Denatured Alcohol | 10 ml |
| Solution C | |
| Ethylenediamine (70%) | 20 ml |
| Solution A and Solution B were mixed together and immediately before use, Solution C and water were added thereto to make 1.0 liter. | |
| **Stabilizing Solution** | |
| Water | 800 ml |
| Formaldehyde (37%) | 10 ml |
| 40% Aqueous Solution of Polyethylene glycol molecular weight: 400) | 5 ml |
| Water to make | 1.0 liter |

Processing B

| Processing Step | Temperature | Time |
|---|---|---|
| Pre-bath | 27°C | 10 sec. |
| Washing | " | 15 sec. |
| Color Development | " | 5 min. 20 sec. |
| Washing | " | 15 sec. |
| First Fixing | " | 1 min. |
| Washing | " | 40 sec. |
| Bleaching | " | 3 min. |
| Washing | " | 1 min. |
| Second Fixing | " | 2 min. |
| Washing | " | 5 min. |
| Stabilizing | " | 10 sec. |

The compositions of the processing solutions were the same as described in Processing A.

Processing C

| Processing Step | Temperature | Time |
|---|---|---|
| Pre-bath | 27°C | 10 sec. |
| Washing | " | 15 sec. |
| Color Development | " | 5 min. 20 sec. |
| Washing | " | 15 sec. |
| First Fixing | " | 1 min. |
| Washing | " | 40 sec. |
| Silver Bleach Inhibiting | Room Temperature | 30 sec. |

-continued

| Processing C | | |
|---|---|---|
| Processing Step | Temperature | Time |
| Washing | 27°C | 1 min. |
| Bleaching | " | 3 min. |
| Washing | " | 1 min. |
| Second Fixing | " | 2 min. |
| Washing | " | 5 min. |
| Stabilizing | " | 10 sec. |

The compositions of the Silver Bleach Inhibitor Solution and the Bleaching Solution were as follows.

| | |
|---|---|
| Silver Bleach Inhibitor Solution | |
| Water | 800 ml |
| Silver Bleach Inhibitor of the Present Invention (Compound 4) | 100 g |
| Water to make | 1.0 liter |
| Bleaching Solution | |
| Water | 700 ml |
| Ammonium Bromide | 150 g |
| Tetrasodium Iron (III) Salt of Ethylenediamine Tetraacetic Acid | 130 g |
| Sodium Acetate | 15 g |
| Water to make | 1.0 liter |

The compositions of the processing solutions other than the Silver Bleach Inhibitor Solution and the Bleaching Solution were the same as described in Processing A.

Table 1

| | Processing | | |
|---|---|---|---|
| | A | B | C |
| Infrared Density | 1.90 | 0.35 | 1.70 |

From the results shown in Table 1, it will be understood that by applying the silver bleach inhibitor according to the present invention a high infrared density nearly comparable to that obtained by a conventional process including a sound development step can be obtained, while a very low infrared density was obtained when using Processing B.

EXAMPLE 2

Sample (I) as described in Example 1 was exposed using the same procedure as described in Example 1 and subjected to processing according to Processing D or Processing E. The infrared densities of the samples were measured in the same manner as described in Example 1. The results obtained are shown in Table 2.

| Processing D | | |
|---|---|---|
| Processing Step | Temperature | Time |
| Pre-bath | 37.8°C | 15 sec. |
| Washing | " | 30 sec. |
| Color Development | " | 2 min. 30 sec. |
| Stop | " | 30 sec. |
| Washing | " | 30 sec. |
| Silver Bleach Inhibiting | Room Temperature | 30 sec. |
| Washing | 37.8°C | 1 min. |
| Bleaching | " | 1 min. 20 sec. |
| Washing | " | 1 min. |
| Fixing | " | 2 min. |
| Washing | " | 2 min. |

-continued

| Processing D | | |
|---|---|---|
| Processing Step | Temperature | Time |
| Stabilizing | " | 10 sec. |

The compositions of the processing solutions were as follows.

| | |
|---|---|
| Pre-bath Solution | |
| The same as the Pre-bath Solution of Processing A | |
| Color Developer Solution | |
| Water | 900 ml |
| Trisodium Salt of Nitrilotriacetic Acid | 1 g |
| Sodium Sulfite | 4 g |
| Sodium Carbonate (monohydrate) | 30 g |
| Potassium Bromide | 2 g |
| Hydroxylamine Sulfate | 2 g |
| 4-Amino-3-methyl-N-ethyl-N-β-hydroxyethylaniline | 4 g |
| Water to make | 1.0 liter |
| Stop Solution | |
| Water | 800 ml |
| Glacial Acetic Acid | 30 ml |
| Water to make | 1.0 liter |
| Silver Bleach Inhibitor Solution | |
| Water | 800 ml |
| Silver Bleach Inhibitor of the Present Invention (Compound 9) | 20 g |
| 10% Aqueous Solution of Sodium Hydroxide | 10 ml |
| Water to make | 1.0 liter |
| Bleaching Solution | |
| The same as the Bleaching Solution of Processing C. | |
| Fixing Solution | |
| Water | 700 ml |
| Sodium Tetrapolyphosphoric Acid Salt | 2 g |
| Sodium Sulfite | 5 g |
| Sodium Thiosulfate (70%) | 120 ml |
| Sodium Bisulfite | 5 g |
| Water to make | 1.0 liter |

STABILIZING SOLUTION

The same as the Stabilizing Solution of Processing A.

PROCESSING E

The same as Processing D except for omitting the Silver Bleach Inhibiting Step.

Table 2

| Processing | Infrared Density |
|---|---|
| Processing D | 1.40 |
| Processing E | 0.35 |

By Processing D according to the present invention a high infrared density was obtained, whereas in Processing E in which the Silver Bleach Inhibitor Solution was not used only a low infrared density was obtained.

EXAMPLE 3

Sample (I) as described in Example 1 was exposed using the same procedure as described in Example 1 and subjected to processing according to Processing F which is the same as Processing D described in Example 2 except for the Silver Bleach Inhibitor Solution. The compositions of the Silver Bleach Inhibitor Solutions used in Processing F are shown in Table 3. After processing, the infrared densities of the samples were measured in the same manner as described in Example 1. The results are shown in Table 4.

Table 3

| Silver Bleach Inhibitor Solution | F-1 | F-2 | F-3 | F-4 |
|---|---|---|---|---|
| Water | 800 ml | 800 ml | 800 ml | 800 ml |
| Silver Bleach Inhibitor of the Present Invention | Compound 9 20 g | Compound 2 100 g | Compound 9 20 g | Compound 4 100 g |
| | — | — | Compound 2 100 g | Compound 2 100 g |
| 10% NaOH Aq. Solution | 10 ml | — | 10 ml | — |
| Water to make | 1 liter | 1 liter | 1 liter | 1 liter |

Table 4

| Silver Bleach Inhibitor Solution | F-1 | F-2 | F-3 | F-4 |
|---|---|---|---|---|
| Infrared Density | 1.40 | 1.25 | 2.35 | 2.14 |

It will be apparent that a high infrared density can be obtained using the silver bleach inhibitor according to the present invention, and that the effect can be increased by using two or more silver bleach inhibitors in combination.

EXAMPLE 4

Sample (I) as described in Example 1 was exposed using the same procedure as described in Example 1 and subjected to processing according to Processing G which is the same as Processing D described in Example 2 except for using the following solutions as the Silver Bleach Inhibitor Solution and the Bleaching Solution.

After processing, the infrared density of the sample was measured in the same manner as described in Example 1 and it was 1.85. In this example a high infrared density was also obtained.

| Silver Bleach Inhibitor Solution | |
|---|---|
| Water | 800 ml |
| Silver Bleach Inhibitor of the Present Invention (Compound 9) | 20 g |
| Silver Bleach Inhibitor of the Present Invention (Compound 2) | 100 g |
| 10% Aqueous Sodium Hydroxide Solution | 10 ml |
| Water to make | 1.0 liter |
| **Bleaching Solution** | |
| Water | 800 ml |
| Ferric Chloride | 30 g |
| Citric Acid | 10 g |
| Water to make | 1.0 liter |

While the invention has been described in detail and with reference to specific embodiments thereof, it will be apparent to one skilled in the art that various changes and modifications can be made therein without departing from the spirit and scope thereof.

What is claimed is:

1. A process for forming an optical sound track which consists essentially of applying a nitrogen containing heterocyclic compound in which at least one of the nitrogen atoms is connected to a group having 6 or more carbon atoms to form a quaternary salt to a sound track area of a multi-layer color photographic material, after color developing but prior to bleaching wherein said nitrogen containing heterocyclic compound is represented by the general formula:

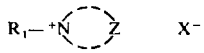

wherein Z represents the atoms necessary to form a pyridine ring, an imidazole ring or a quinoline ring; $X^-$ represent an anion; $R_1$ represents a group having 6 or more carbon atoms and is selected from the group consisting of a. an alkyl or an alkenyl group, (b) $R_2—A—CH_2\underset{\underset{OH}{|}}{C}HCH_2—$, (c) $R_2—B—\underset{\underset{R_3}{|}}{C}H—$, and (d) $R_2—A—(C)_m—(D)_n—(CH_2\underset{\underset{OH}{|}}{C}HCH_2)_p—$ wherein $R_2$ represents an alkyl group, an alkenyl group, or an alkylaryl group; $R_3$ represents a hydrogen atom or a methyl group; A represents —O—, —S—, —COO—, or $—NCH_3—$; B represents —O—, —COO—, —CONH—, or $—CONHC_2H_4CONH—$; C represents an oxyalkylene group; D represents $—CH_2CH_2—$ or —O—; m represents an integer of 1 to 40; n represents O or 1; and p represents O or 1.

2. A process for forming an optical sound track which consists essentially of applying a nitrogen containing heterocyclic compound in which at least one of the nitrogen atoms is connected to a group having 6 or more carbon atoms to form a quaternary salt to a sound track area having a silver image of a multi-layer color photographic material, after color developing but prior to bleaching wherein said nitrogen containing heterocyclic compound is represented by the general formula;

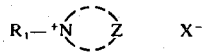

wherein Z represents the atoms necessary to form a pyridine ring, an imidazole ring or quinoline ring; $X^-$ represent an anion; and $R_1$ represents a group having 6 or more carbon atoms and is selected from the group consisting of a. an alkyl or an alkenyl group, (b) $R_2—A—CH_2\underset{\underset{OH}{|}}{C}HCH_2—$, (c) $R_2-B-\underset{\underset{R_3}{|}}{C}H-$, and (d) $R_2-A-(C)_m-(D)_n-(CH_2\underset{\underset{OH}{|}}{C}HCH_2)_p-$ wherein $R_2$ represents an alkyl group, an alkenyl group, or an alkylarly group; $R_3$ represents a hydrogen atom or a methyl group; A represents —O—, —S—, —COO—, or $-NCH_3-$; B represents —O—, —COO—, —CONH—, or $-CONHC_2H_4CONH-$; C represents an oxyalkylene group; D represents $-CH_2CH_2-$ or —O—; m represents an integer of 1 to 40; n represents 0 or 1; and p represents O or 1.

3. A process for forming an optical sound track on a multi-layer color photographic material, which consists essentially of developing a picture image, and sound image exposed multilayer color photographic material; applying a nitrogen containing heterocyclic compound in which at least one of the nitrogen atoms is connected to a group having 6 or more carbon atoms to form a quateraary salt to a sound track area of the multi-layer color photographic material; and bleaching and fixing the multi-layer color photographic material wherein said nitrogen containing heterocyclic compound is represented by the general formula:

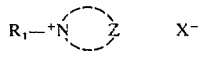

wherein Z represents the atoms necessary to form a pyridine ring, an imidazole ring or a quinoline ring; $X^-$ represent an anion; and $R_1$ represents a group having 6 or more carbon atoms and is selected from the group consisting of a. an alkyl or an alkenyl group, (b) $R_2-A-CH_2\underset{\underset{OH}{|}}{C}HCH_2-$, (c) $R_2-B-\underset{\underset{R_3}{|}}{C}H-$, and (d) $R_2-A-(C)_m-(D)_n-(CH_2\underset{\underset{OH}{|}}{C}HCH_2)_p-$ wherein $R_2$ represents an alkyl group, an alkenyl group, or an alkylaryl group; $R_3$ represents a hydrogen atom or a methyl group; A represents —O—, —S—, —COO—, or $-NCH_3-$; B represents —O—, —COO—, —CONH—, or $-CONHC_2H_4CONH-$; C represents an oxyalkylene group; D represents $-CH_2CH_2-$ or —O—; m represents an integer of 1 to 40; n represents O or 1; and p represents O or 1.

4. A process for forming an optical sound track on a multi-layer color photographic material which consists essentially of developing a picture image and sound image exposed multilayer color photographic material; applying a nitrogen containing heterocyclic compound in which at least one of the nitrogen atoms is connected to a group having 6 or more carbon atoms to form a quanternary salt to a sound track area having a silver image in the multi-layer color photographic material; and bleaching and fixing the multi-layer color photographic material wherein said nitrogen containing heterocyclic compound is represented by the general formula:

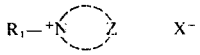

wherein Z represents the atoms necessary to form a pyridine ring, an imidazole ring or a quinoline ring; $X^-$ represent an anion; and $R_1$ represents a group having 6 or more carbon atoms and is selected from the group consisting of a. an alkyl or an alkenyl group, (b) $R_2-A-CH_2\underset{\underset{OH}{|}}{C}HCH_2-$, (c) $R_2-B-\underset{\underset{R_3}{|}}{C}H-$, and (d) $R_2-A-(C)_m-(D)_n-(CH_2\underset{\underset{OH}{|}}{C}HCH_2)_p-$ wherein $R_2$ represents an alkyl group, an alkenyl group, or an alkylaryl group; $R_3$ represents a hydrogen atom or a methyl group; A represents —O—, —S—, —COO—, or $-NCH_3-$; B represents —O—, —COO—, —CONH—, or $-CONHC_2H_4CONH-$; C represents an oxyalkylene group; D represents $-CH_2CH_2-$ or —O—; m represents an integer of 1 to 40; n represents 0 or 1; and p represents 0 or 1.

5. A process for forming an optical sound track on a multi-layer color photographic material consisting essentially of developing a picture image and sound image exposed multi-layer color photographic material; applying a nitrogen containing heterocyclic compound in which at least one of the nitrogen atoms is connected to a group having 6 or more carbon atoms to form a quaternary salt to a sound track area of the multi-layer color photographic material; and bleaching the multilayer color photographic material wherein said nitrogen containing heterocyclic compound is represented by the general formula:

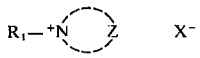

wherein Z represents the atoms necessary to form a pyridine ring, an imidazole ring or a quinoline ring; $X^-$ represent an anion; and $R_1$ represents a group having 6 or more carbon atoms and is selected from the group consisting of a. an alkyl or an alkenyl group, (b) $R_2-A-CH_2\underset{\underset{OH}{|}}{C}HCH_2-$, (c) $R_2-B-\underset{\underset{R_3}{|}}{C}H-$, and (d) $R_2-A-(C)_m-(D)_n-(CH_2\underset{\underset{OH}{|}}{C}HCH_2)_p-$ wherein $R_2$ represents an alkyl group, an alkenyl group, or an alkylaryl group; $R_3$ represents a hydrogen atoms or a methyl group; A represents —O—, —S—, —COO—, or —$NCH_3$—; B represents —O—, —COO—, —CONH—, or —$CONHC_2H_4CONH$—; C represents an oxyalkylene group; D represents —$CH_2CH_2$— or —O—; m represents an integer of 1 to 40; n represents 0 or 1; and p represents 0 or 1.

6. A process for forming an optical sound track on a multi-layer color photographic material consisting essentially of developing a picture image and sound image exposed multi-layer color photographic material; applying a nitrogen containing heterocyclic compound in which at least one of the nitrogen atoms is connected to a group having 6 or more carbon atoms to form a quaternary salt to a sound track area of the multi-layer color photographic material; and bleach-fixing the multi-layer color photographic material wherein said nitrogen containing heterocyclic compound is represented by the general formula:

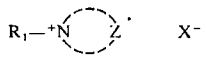

wherein Z represents the atoms necessary to form a pyridine ring, an imidazole ring or a quinoline ring; $X^-$ represent an anion; and $R_1$ represents a group having 6 or more carbon atoms and is selected from the group consisting of a. an alkyl or an alkenyl group.

(b) $R_2—A—CH_2\underset{\underset{OH}{|}}{C}HCH_2—$, (c) $R_2—B—\underset{\underset{R_3}{|}}{C}H—$, and (d) $R_2—A—(C)_m—(D)_n—(CH_2\underset{\underset{OH}{|}}{C}HCH_2)_p—$ wherein $R_2$ represents an alkyl group, an alkenyl group, or an alkylaryl group; $R_3$ represents a hydrogen atom or a methyl group; A represents —O—, —S—, —COO—, or —$NCH_3$—; B represents —O—, —COO—, —CONH—, or —$CONHC_2H_4CONH$—; C represents an oxyalkylene group; D represents —$CH_2CH_2$— or —O—; m represents an integer of 1to 40; n represents 0 or 1; and p represents 0 or 1.

7. The process for forming an optical sound track as claimed in claim 2, wherein the bleaching agent used in said bleaching is a compound containing iron (III).

8. The process for forming an optical sound track as claimed in claim 7, wherein said iron (III) compound in ferric chloride.

9. The process for forming an optical sound track as claimed in claim 7, wherein said iron (III) compound is an iron (III) salt of ethylenediaminetetraacetic acid.

10. The process for forming an optical sound track as claimed in claim 2, including exposing said multi-layer color photographic light-sensitive material and then subjecting the color photographic material to the steps of immersion in a pre-bath; color developing; stopping; silver bleach inhibiting; bleaching; fixing; and stabilizing.

11. The process for forming an optical sound track as claimed in claim 2, including exposing said multi-layer color photographic light-sensitive material and then subjecting the color photographic material to the steps of immersion in a pre-bath; color developing; stopping; silver bleach inhibiting; bleach-fixing; and stabilizing.

12. The process for forming an optical sound track as claimed in claim 2, including exposing said multi-layer color photographic light-sensitive material and then subjecting the color photographic material to the steps of immersion in a pre-bath; color developing; stop-fixing; silver bleach inhibiting; bleaching; fixing; and stabilizing.

13. The process for forming an optical sound track as claimed in claim 2, including exposing said multi-layer color photographic light-sensitive material and then subjecting the color photographic material to the steps of immersion in a pre-bath; color developing; stop-fixing; silver bleach inhibiting; bleach-fixing; and stabilizing.

14. The process for forming an optical sound track as claimed in claim 1, wherein said pyridine ring, imidazole ring or quinoline ring has an alkyl group having 1 to 12 carbon atoms on ring forming atoms other than the quaternary nitrogen atom.

15. The process for forming an optical sound track as claimed in claim 1, wherein said X is bromide, chloride, thiocyanate, sulfonate or perchlorate.

16. The process for forming an optical sound track as claimed in claim 2, wherein said applying comprises applying at least two of said nitrogen containing heterocyclic compounds in combination.

17. A process for forming an optical sound track which comprises developing an exposed multi-layer color photographic material to form a picture image and a sound image, contacting only the silver of the sound track area with a solution consisting essentially of a silver bleach inhibiting nitrogen containing heterocyclic compound in which at least one of the nitrogen atoms is connected to a group having 6 or more carbon atoms to form a quaternary salt and bleaching and fixing the multi-layer color photographic material wherein said nitrogen containing heterocyclic compound is represented by the general formula;

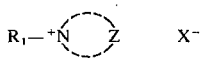

wherein Z represents the atoms necessary to form a pyridine ring, an imidazole ring or quinoline ring; $X^-$ represent an anion; and $R_1$ represnets a group having 6 or more carbon atoms and is selected from the group consisting of a. an alkyl or an alkenyl group, (b) $R_2—A—CH_2\underset{\underset{OH}{|}}{C}HCH_2—$, (c) $R_2—B—\underset{\underset{R_3}{|}}{C}H—$, and (d) $R_2—A—(C)_m—(D)_n—(CH_2\underset{\underset{OH}{|}}{C}HCH_2)_p$ wherein $R_2$ represents an alkyl group, an alkenyl group, or an alkylaryl group; $R_3$ represents a hydrogen atom or a methyl group; A represents —O—, —S—, —COO—, or —$NCH_3$—; B represents —O—, —COO—, —CONH—, or —$CONHC_2H_4CONH$—; C represents an oxyalkylene group; D represents —$CH_2CH_2$— or —O—; m represents an integer of 1 to 40; n represents 0 or 1; and p represents 0 or 1.

18. The process for forming an optical sound track as claimed in claim 17, wherein said solution containing said heterocyclic compound is an aqueous solution.

19. The process for forming an optical sound track as claimed in claim 18, wherein said solution containing said heterocyclic compound is an aqueous methanol solution.

20. The process for forming an optical sound track as claimed in claim 18, wherein said solution containing said heterocyclic compound is an aqueous ethanol solution.

21. The process for forming an optical sound track as claimed in claim 18, wherein said solution containing said heterocyclic compound has a pH ranging from about 5 to 13.

22. The process for forming an optical sound track as claimed in claim 18, wherein said nitrogen containing heterocyclic compound is present in said solution in an amount of about 0.5 to 30 weight %.

* * * * *